US006506071B2

(12) United States Patent
Lange

(10) Patent No.: US 6,506,071 B2
(45) Date of Patent: Jan. 14, 2003

(54) ELECTRICAL MODULAR TERMINAL

(75) Inventor: Oliver Lange, Schieder-Schwalenberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 09/950,814

(22) Filed: Sep. 13, 2001

(65) Prior Publication Data

US 2002/0072266 A1 Jun. 13, 2002

(30) Foreign Application Priority Data

Sep. 13, 2000 (DE) ..... 100 45 498

(51) Int. Cl.[7] ..... H01R 13/67

(52) U.S. Cl. ..... 439/358; 439/715; 439/835; 439/716

(58) Field of Search ..... 439/716, 715, 439/358, 835, 709, 821

(56) References Cited

U.S. PATENT DOCUMENTS 5,318,461 A * 6/1994 Frikkee et al. ..... 439/715
5,588,881 A * 12/1996 Eggert et al. ..... 439/716
5,658,172 A 8/1997 Schmidt et al.

FOREIGN PATENT DOCUMENTS

DE 295 02 186 5/1995
DE 295 14 711 U1 12/1995
DE 196 10 854 A1 9/1997

* cited by examiner

*Primary Examiner*—P. Austin Bradley
*Assistant Examiner*—Briggitte R. Hammond
(74) *Attorney, Agent, or Firm*—Nixon Peabody LLP; David S. Safran

(57) ABSTRACT

An electrical modular terminal, especially for latching onto a mounting rail, with a base terminal (2) and with at least one plug (3, 4), the base terminal (2) having a terminal housing (7) which made of insulating material, at least one terminal element (8, 9) located in it and at least two sockets which are electrically connected to the terminal element (8, 9) or to terminal elements (8, 9), the plug (3, 4) having a plug housing (13, 14) which is made of insulating material, at least one terminal element (15) located therein and a plug-in contact which is electrically connected to the at least one terminal element (15), and the at least one plug (3, 4) being mechanically connected by means of a fastener to the terminal housing (7) of the base terminal (2). The at least on plug can be plugged into the two sockets of the base terminal (2), and in addition, there is mechanical attachment of the plugs (3, 4) and the base terminal (2), an interlock recess (19) being formed in the terminal housing (7) of the base terminal (2) between the two sockets for receiving the fastener an the plug (3, 4) plugged into the inner one of the two sockets for mechanically connecting it to the terminal housing (7) of the base terminal (2).

14 Claims, 4 Drawing Sheets

ELECTRICAL MODULAR TERMINAL

BACKGROUND OF THE INVENTION

1. Field of the Invention

The invention relates to an electrical modular terminal, especially for latching onto a mounting rail, with a base terminal and with a plug, the base terminal having a terminal housing, at least one terminal element located in it and at least two sockets which are electrically connected to the terminal element or terminal elements, the plug having a plug housing, at least one terminal element located therein and a plug-in contact which is electrically connected to the terminal element or the terminal elements, and the plug being mechanically connected by means of a fastener to the terminal housing of the base terminal. Here, the terminal housing and the plug housing are preferably made of insulating material.

2. Description of Related Art

An electrical modular terminal of the initially mentioned type is known from published German Utility Model DE 295 14 711 U1. Here, the base terminal is generally latched onto a mounting rail so that the base terminal represents the stationary part of the electrical modular terminal. Conversely, the plug represents the movable part of the electrical modular terminal since it can be easily slipped onto the corresponding sockets of the base terminal and withdrawn from them again by means of its plug-in contact. While the electrical supply lines are connected to the base terminal or to the terminal elements located in the base terminal, the electrical lines of the individual consumers are connected to the terminal element in the plug. Here, the electrical modular terminals are generally made disk-shaped; they are generally mated to several other electrical modular terminals into a modular terminal block. In these known electrical modular terminals, it is then possible to reduce the wiring work and thus also the installation cost by connecting the electrical conductors of individual consumers to a corresponding number of plugs. Then, the plugs which can be combined into a plug block need only be inserted into a base terminal block, the base terminal block having been composed of a corresponding number of base terminals.

The disadvantage in the electrical modular terminal known from German Utility Model DE 295 14 711 U1 is that the base terminal does indeed have two sockets, but the plug can only be plugged into the outer of the two sockets. This is because the fastener for secure mechanical connection of the plugs and base terminal is attached to the end face of the plug and fits behind a projection of the housing on the end face of the base terminal. The known electrical modular terminal has two terminal elements in the base terminal so that two supply lines can also be connected to the stationary side of the electrical modular terminal. To be able to connect two electrical lines on the other movable side of the modular terminal, the plug also has two terminal elements. However, due to the arrangement of two terminal elements in the plug, the plug is so wide that the second inside socket of the base terminal is covered by the housing of the plug, and thus, is no longer accessible. In this way, another disadvantage arises, i.e., that the possibility of connecting two potentials to the electrical modular terminal which is established on the input side by the arrangement of two terminal elements in the base terminal can no longer be used on the output side since only one socket can be occupied.

In the electrical modular terminal known from DE 295 14 711 U1, the plug can be mechanically locked to the plug housing of the base terminal using an elastic catch arm. To do this, the catch arm has a catch hook on its lower end which can be engaged to a corresponding projection on the plug housing of the base terminal. In order to detach the plug from the base terminal again, the tip of a screwdriver must be used to disengage the catch hook and the projection on the housing. To do this, in the area of the catch hook, there is a pocket on the fastener for inserting the tip of a screwdriver. Thus, the pocket is also located on the lower end of the fastener so that it is only poorly accessible from the operator side. This can be a problem, especially when the electrical modular terminal is located, for example, in a switching cabinet where very little space is available between the modular terminal and the corresponding side wall of the switching cabinet.

SUMMARY OF THE INVENTION

A primary object of this invention is, thus, to improve an electrical modular terminal of the initially described type such that the two sockets of the base terminal can be used to plug in a plug, but in both cases there must be a detachable mechanical attachment of the plugs and base terminal.

This object is achieved, essentially first of all, in that an interlock recess is formed in the housing of the base terminal between the two sockets so that the plug on both sockets can be mechanically connected to the terminal housing of the base terminal. By forming the interlock recess in the base terminal, it is no longer necessary to place the plug on the outer socket so that the fastener can catch laterally on the plug housing of the base terminal.

Advantageously, the electrical modular terminal is made such that the plug can be plugged not only selectively in one of the two sockets, but that, at the same time, one plug at a time can be plugged in the two sockets and that the two plugs can be mechanically connected to the plug housing of the base terminal. If the base terminal has two terminal elements to which two different potentials can be connected via electrical supply lines, because one plug at a time can be plugged into the two sockets, two potentials can be transmitted to the consumer side of the electrical modular terminal.

How the two plugs are formed, in particular, i.e., whether especially in the plugs there is one terminal element or several terminal elements, depends essentially on the available space, and thus, on the length of the base terminal. In applications in which there is no shortage of space, but in which there is the desire to be able to connect as many electrical lines as possible to the electrical modular terminal, there can be two or even more terminal elements in both plugs. However, generally, the available space is limited because the electrical modular terminal is to be accommodated, for example, in switching cabinets. Then, it is advantageous if the plug which is plugged in the outer socket has only one terminal element, while the plug which is plugged in the inner socket can have two terminal elements.

According to one preferred embodiment of the electrical modular terminal according to the invention, the detachment of the plug from the base terminal can be handled especially easily by making the fastener as an elastic catch arm with a handle section, a catch hook and a spring element, and by the catch arm being pivotally supported on the housing of the plug and the spring element being located above the bearing point. This configuration of the fastener yields two advantages independently of one another. Because the fastener is supported as an elastic spring arm with a pivoting capacity on the housing of the plug, and on its one end has a handle section and on its other end a catch hook, actuation of the catch arm is possible solely via the handle section which is easily accessible from the operator side. Thus, the plug can be easily detached by actuating the handle section with one finger. Use of a tool is not necessary. Because a spring element is additionally formed on the elastic catch arm, provisions are made for the catch arm to be permanently kept in its interlocked position when the handle section is not actuated.

According to another preferred embodiment of the electrical modular terminal in accordance with the invention, the fastener is connected to a strain relief element, and an electrical conductor which is connected to the plug can be attached to the strain relief element. In this configuration of the fastener, it thus assumes not only the function of mechanical locking or connection of the plug and the base terminal, but it is also used as strain relief for an electrical line connected to the plug.

In particular, there is a number of possibilities for embodying and developing the electrical modular terminal of the present invention, and especially the fastener as will be apparent from the following detailed description of preferred embodiments in conjunction with the accompanying drawings.

DETAILED DESCRIPTION OF THE INVENTION

Figure 1:
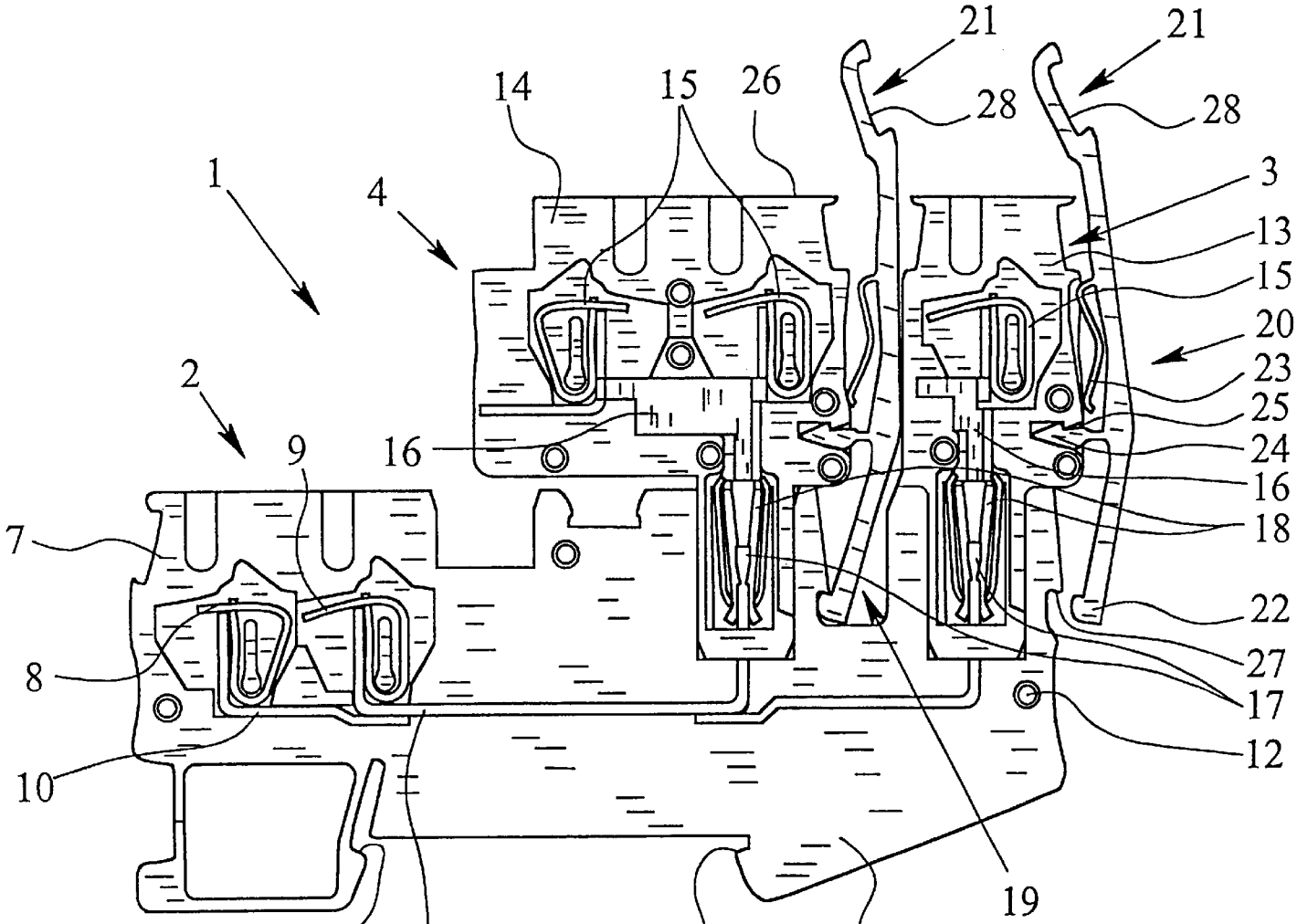
FIG. 1 shows a first embodiment of an electrical modular terminal according to the invention with two connected plugs.

FIG. 1 shows one embodiment of an electrical modular terminal 1 with a base terminal 2 and two plugs 3, 4. The base terminal 2 thus forms the stationary part of the electrical modular terminal 1, while the plugs 3, 4, to the extent they can be called the movable parts of the electrical modular terminal 1, can be inserted into the base terminal 2. The base terminal 2 can be latched onto a mounting rail (not shown), for which corresponding catch elements 6 are made in the foot 5 of the base terminal 2.

The base terminal 2 has a terminal housing 7 which is made of an insulating material and two terminal elements 8, 9 located in it. The terminal elements 8, 9, which are made here as tension spring clamps, but can also be made as screw terminals or as insulation piercing connecting devices, are electrically connected to a respective socket via current bars 10, 11. The disk-shaped or plate-shaped base terminal 2 can be mated to other base terminals 2 so as to form a base terminal block using the catch pins 12 located on the terminal housing.

The plugs 3, 4 comprise a plug housing 13, 14 which is made of an electrically insulating material, there being one terminal element 15 in the plug housing 13 of the plug 3 and two terminal elements 15 in the plug housing 14 of the plug 4. The terminal elements 15 of the plugs 3, 4, in the embodiments of the electrical modular terminals 1 shown, are made as tension spring clamps. The terminal elements 15 of each plug 3, 4 are electrically connected via the current bars 16 to a respective plug-in contact; each plug 3, 4 has only one plug-in contact so that, for the plug 4, the two terminal elements 15 are connected to the plug-in contact via a common current bar 16.

Figure 3:
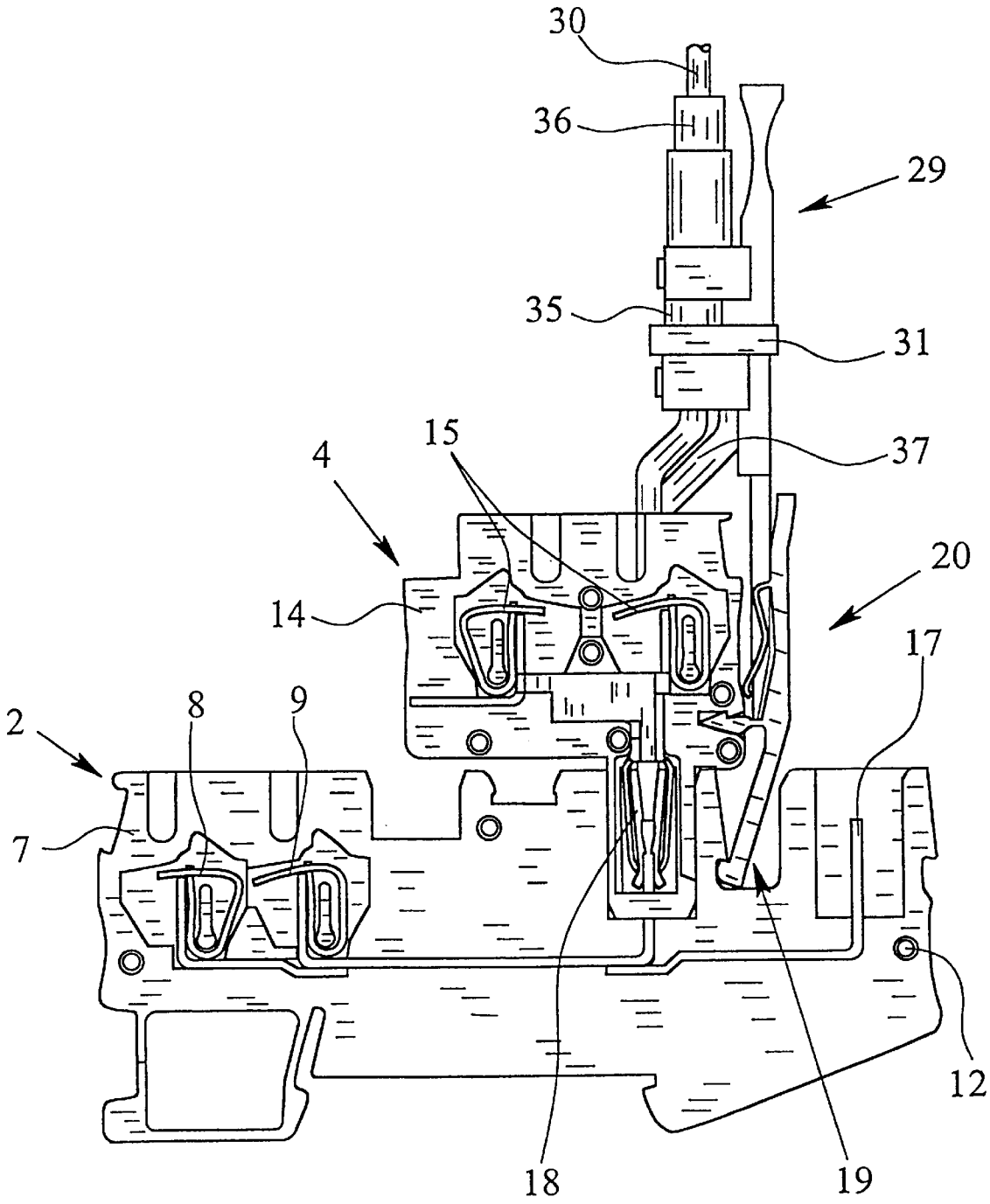
FIG. 3 shows a second embodiment of an electrical modular terminal according to the invention with a catch arm which is connected to a strain relief element.

In the two embodiments shown, in FIGS. 1 & 3, the two plug-in connections are formed by plug pins 17 in the base terminal 2 sockets and female plug-in contacts 18 of the plugs 3, 4 which correspond to them. The connections can be made equally well with female contacts in the base terminal sockets and plug-in contacts pins on the plugs 3, 4. Due to the possibility of being able to plug the plugs 3, 4 quickly and easily into the sockets of the base terminal 2, the connection of individual consumers to the electrical modular terminal 1 is simplified. To do this, a consumer is connected by its electrical lines to the plugs 3, 4 or to a plurality of plugs 3, 4 which are then combined into a plug block. Then, only the plug 3, 4 or the plug block need be plugged into the base terminal 2, or a corresponding base terminal block for start up. The power is supplied by connecting the corresponding supply lines to the terminal elements 8, 9 of the base terminal 2.

To prevent unintentional detachment of the plug 3, 4 from the base terminal 2, the plug 3, 4 can be mechanically connected to the housing 7 of the base terminal 2 by means of a fastener. In the electrical modular terminal 1 according to the invention, the fastener for the inner plug 4 engages in an interlock recess 19 that is located in the terminal housing 7 between the sockets. Due to the provision of this interlock recess 19, the outside plug 3 can be attached to the end face of the terminal housing 7, and the inner plug 4 can be attached to the terminal housing 7 between the two sockets.

In the embodiments of the electrical modular terminal 1 shown in the figures, the fastener is made as an elastic catch arm 20. The catch arm 20 on its top end has a handle section 21, a catch hook 22 on its bottom end and a spring element 23 in its middle area. The catch arm 20 is supported on the housing 13, 14 of the plug 3, 4, for which it has a bearing element 24 and the housing 13, 14 of the plug 3, 4 has a bearing recess 25 which corresponds to it.

FIG. 1 shows that, with a corresponding configuration of the plug 3, 4 and the base terminal 2, a plug 3, 4 can simultaneously plugged into a respective one of the two sockets and mechanically locked to the housing 7 of the base terminal 2 using a respective catch arm 20. The base terminal 2, which is shown in FIGS. 1 & 3, is made such that the inner plug 4 can have a larger structural shape and thus also two terminal elements 15, while the outer plug 3 has a narrower structural shape, and thus, has only one terminal element 15. If the outer plug 3 is also to have two terminal elements 15, a correspondingly longer base terminal 2 must be used if the larger plug 3 is not to cover the interlock recess 10 and the second socket.

By placing the handle section 21 on the top end of the catch arm 20, the handle section 21 projects over the upper end 26 of the plug 3, 4, so that the catch arm 20 can be easily actuated by hand, and thus, the plug 3, 4 can be detached from the base terminal 2. This is especially advantageous when the electrical modular terminal 1 is located, for example, in a switching cabinet, such that there is only very little free space between the end face of the electrical modular terminal 1 and the housing wall of the switching cabinet. Because the catch arm 20 can be actuated simply by pressing with the finger on the handle section 21, an additional tool for detaching the plug 3, 4 is not necessary. Placing and forming the spring element 23 above the bearing element 24 of the catch arm 20 ensures that the catch hook 22, in the unactuated state of the catch arm 20, fits against the corresponding housing projection 27 in the terminal housing 7, and thus, the plug 3, 4 is locked to the base terminal 2.

Figure 2:
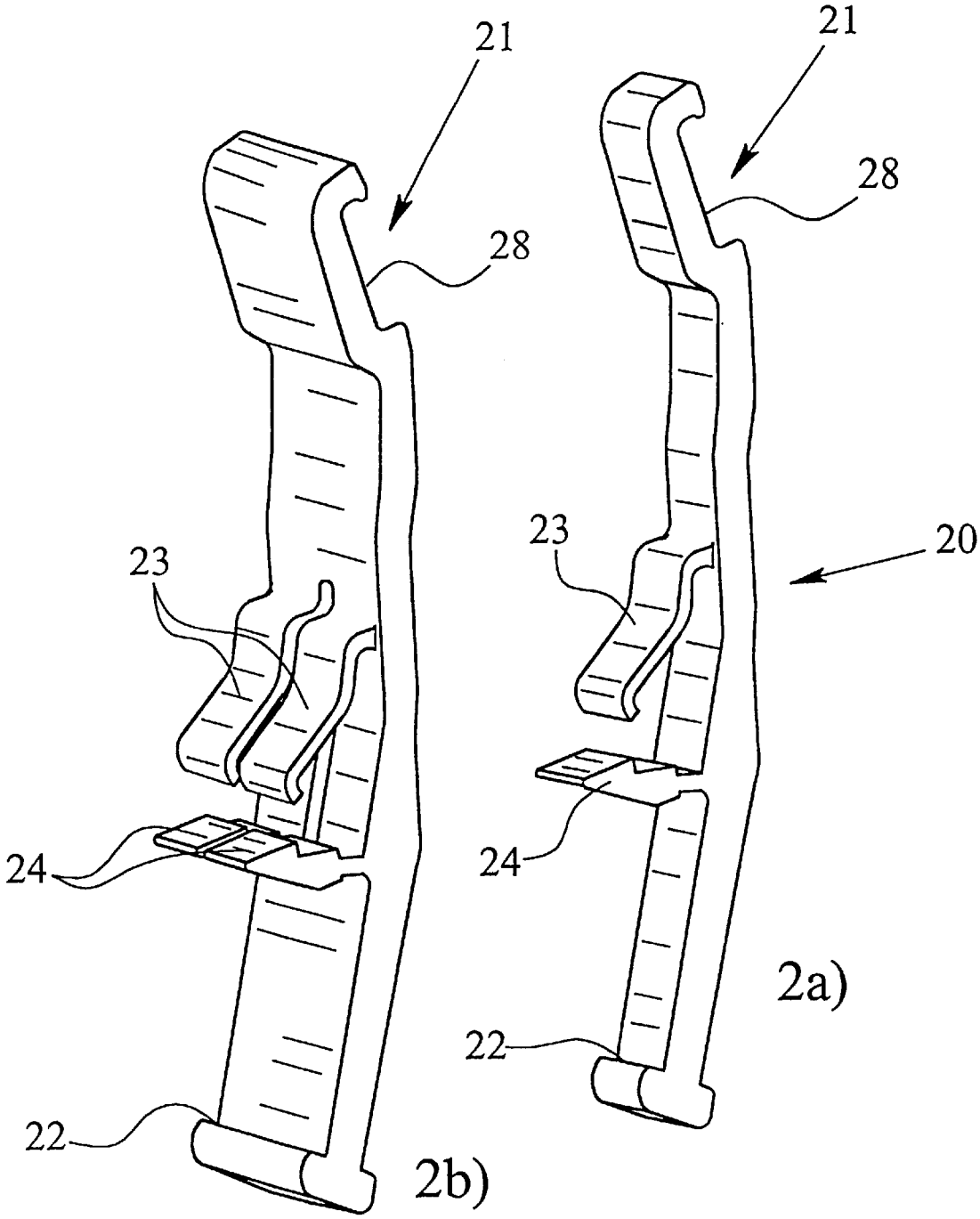
FIGS. 2(*a*) & 2(*b*) each show a respective embodiment of a catch arm for mechanical attachment of a plug to the terminal housing of the base terminal of a modular terminal in accordance with the invention.

FIGS. 1, 2(*a*) & 2(*b*) clearly show that the handle section 21 of the catch arm 20 has a recess 28. The recess 28 can be made either exclusively as a grip aid and slip protection when the handle section 21 of the catch arm 20 is actuated or can also be used as a receiver for an identification plate. Using these identification plates (not shown), for a modular terminal block comprised of several electrical modular terminals 1, the individual plugs 3, 4 can be easily assigned to the consumers connected to the modular terminal block. FIGS. 1, 2(*a*) & 2(*b*) likewise show that the catch arm 20 can be easily locked into the corresponding bearing recess 25 of the housing 13, 14 of the plug 3, 4 using the bearing element 24. This facilitates the production both of the plug 3, 4 and of the plug housing 13, 14 as well as the catch arms 20. In addition, a defective catch arm 20 can be easily replaced without the need to replace the entire plug 3, 4. It is also possible to use a catch arm 20 selectively for different plugs 3, 4 so that fewer catch arms 20 are needed as plugs 3, 4 in a modular terminal block.

FIGS. 2(*a*) & 2(*b*) shows two embodiments of a catch arm 20, each of a different width. The catch arm 20 shown in FIG. 2*a* is used to secure a single disk-shaped plug 3, 4, while the catch arm 20 shown in FIG. 2*b* is used for securing two assembled plugs 3, 4. Consequently, the catch arm 20 shown in FIG. 2*b* has two spring elements 23 and two bearing elements 24. Instead of two spring elements 23 separate from one another there is, however, also the possibility of using only one spring element with twice the width.

Figure 4:
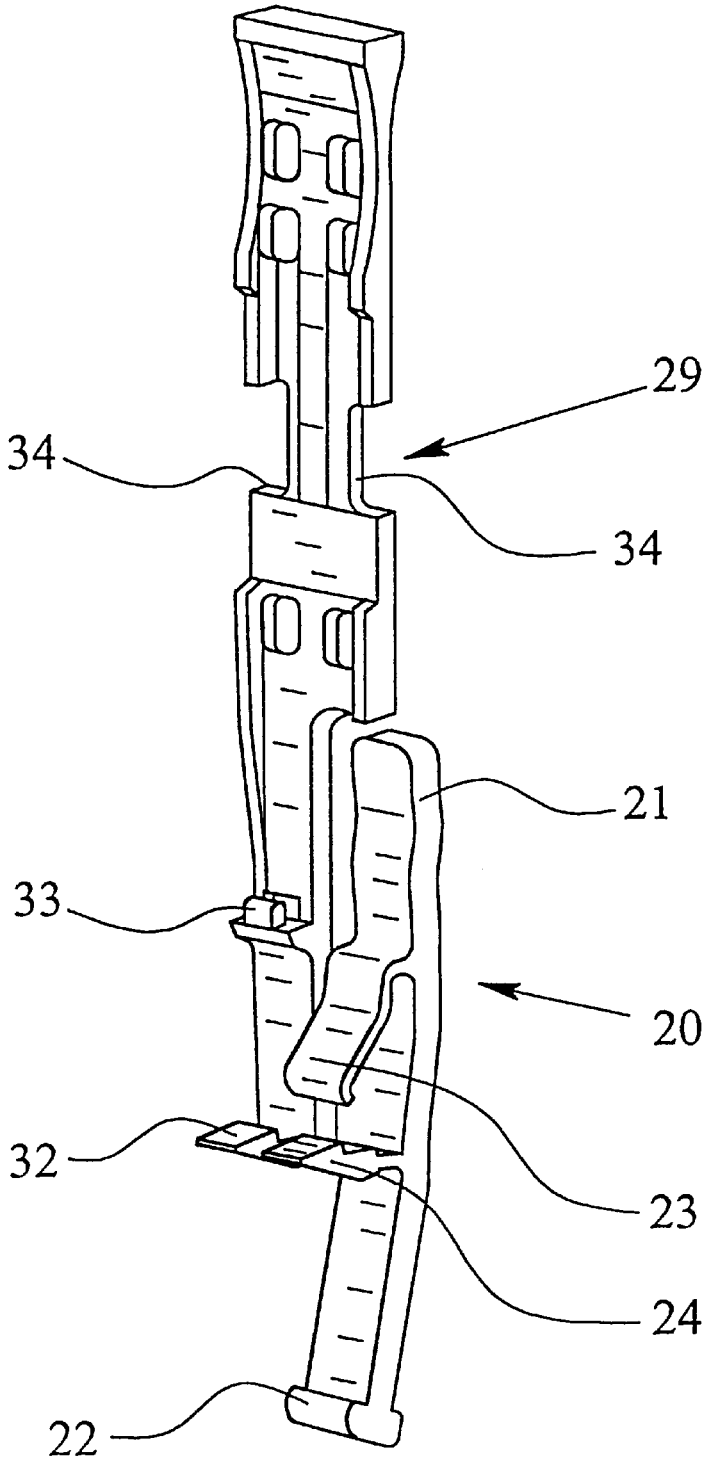
FIG. 4 shows the catch arm connected to the strain relief element of FIG. 3 embodiment.

FIGS. 3 & 4 now show another embodiment of the electrical modular terminal 1 in accordance with the invention, the electrical modular terminal 1 shown in FIG. 3 differs from the electrical modular terminal 1 shown in FIG. 1, first of all, in that, here, only one plug 4 is shown plugged in. However, the actual difference is that the fastener has not only a catch arm 20, but also a strain relief element 29. An electrical conductor 30 connected to the plug 4 is attached to the strain relief element 29 by means of a cable connector 31. By attaching the electrical conductor 30 to the strain relief element 20, besides strain relief of the line ends connected to the terminal elements 15, alignment of the electrical conductor is also effected. The strain relief element 29, like the catch arm 20, has a bearing element 32 which can be inserted into a corresponding bearing recess (not shown here) in the housing 14 of the plug 4 or an extension of the bearing recess for bearing element 24. In addition, the strain relief element 29, likewise, has a catch hook 33 with which the strain relief element 29 can be attached to the plug housing 14 of the plug 4. In the area of the strain relief element 29 in which the electrical conductor 30 is attached using the cable connector 31, two recesss 34 are made in the strain relief element 29 for positioning of the cable connector 31.

FIG. 3 shows that the strain relief element 29 is used not only to attach the electrical line 30 using the cable connector 31, but in addition is made as an attachment for shielding 35. The shield 36 of a shielded electrical cable can be attached to this shielding 35, making electrical contact, the shielding 35 being connected to a piece 37 of the line which is connected to the grounding terminal of the electrical modular terminal 1.

While various embodiments in accordance with the present invention have been shown and described, it is understood that the invention is not limited thereto. These embodiments may be changed, modified and further applied by those skilled in the art. Therefore, this invention is not limited to the details shown and described previously but also includes all such changes and modifications which are encompassed by the appended claims.

What is claimed is:

1. Electrical modular terminal comprising:

a base terminal having a terminal housing with at least one terminal element located therein and with at least two sockets located therein on one side of the terminal housing, the sockets being electrically connected to the at least one terminal element of the terminal housing; and at least one plug having a plug housing with at least one terminal element located therein and a plug-in contact which is electrically connected to the at least one terminal element of the plug housing, the at least one plug being mechanically connected to the terminal housing of the base terminal;

wherein an interlock recess is provided in the terminal housing of the base terminal between the at least two sockets, said interlock recess receiving and being engaged by a fastener for mechanically connecting the at least one plug to the terminal housing of the base terminal in an inner one of said at least two sockets, and wherein said at least one plug comprises two plugs; wherein each of said two plugs can be plugged simultaneously in a respective one of the at least two sockets; and wherein each of the two plugs is mechanically connected to the plug housing of the base terminal by a respective fastener.

2. Electrical modular terminal as claimed in claim 1, wherein the terminal housing of the base terminal is configured for latching onto a mounting rail.

3. Electrical modular terminal as claimed in claim 1, wherein the plug which is plugged into an outer one of said sockets has one terminal element and the plug is plugged into the inner one of said sockets has two terminal elements.

4. Electrical modular terminal as claimed in claim 3, wherein each fastener comprises an elastic catch arm with a handle section, a catch hook and a spring element; and wherein the catch arm is pivotally supported on the plug housing of the respective plug and the spring element is located above a bearing point of the catch arm on the plug housing.

5. Electrical modular terminal as claimed in claim 4, wherein the catch arm has a bearing element; wherein the plug housing of the plug has a bearing recess which corresponds to the bearing element; and wherein the bearing element is insertable into the bearing recess.

6. Electrical modular terminal as claimed in claim 4, wherein the handle section has a recess for holding an identification plate.

7. Electrical modular terminal as claimed in claim 1, further including a fastener wherein the fastener comprises an elastic catch arm with a handle section, a catch hook and a spring element; and wherein the catch arm is pivotally supported on the plug housing of the plug and the spring element is located above a bearing point of the catch arm on the plug housing.

8. Electrical modular terminal as claimed in claim 7, wherein the catch arm has a bearing element; wherein the plug housing of the plug has a bearing recess which corresponds to the bearing element; and wherein the bearing element is insertable into the bearing recess.

9. Electrical modular terminal as claimed in claim 7, wherein the handle section has a recess for holding an identification plate.

10. Electrical modular terminal comprising:

a base terminal having a terminal housing with at least one terminal element located therein and with at least two sockets located therein on one side of the terminal housing, the sockets being electrically connected to the at least one terminal element of the terminal housing; and at least one plug having a plug housing with at least one terminal element located therein and a plug-in contact which is electrically connected to the at least one terminal element of the plug housing, the at least one plug being mechanically connected to the terminal housing of the base terminal;

wherein an interlock recess is provided in the terminal housing of the base terminal between the at least two sockets, said interlock recess receiving and being engaged by a fastener for mechanically connecting the at least one plug to the terminal housing of the base terminal in an inner one of said at least two sockets, and further including a fastener, wherein the fastener is connected to a strain relief element and an electrical conductor, which is connected to the at least one plug, is attachable to the strain relief element.

11. Electrical modular terminal as claimed in claim 10, wherein the strain relief element has at least one of a bearing element and a catch hook; and wherein in the plug housing of the plug is provided with at least one of a corresponding bearing recess and a housing projection which corresponds to the catch hook.

12. Electrical modular terminal as claimed in claim 10, wherein shielding is attached to the strain relief element.

13. Electrical modular terminal as claimed in claim 10, wherein the fastener is pivotally connected to the strain relief element.

14. Electrical modular terminal as claimed in claim 13, wherein a shielding is attached to the strain relief element.

* * * * *